US011609507B1

(12) United States Patent
Tomita

(10) Patent No.: US 11,609,507 B1
(45) Date of Patent: Mar. 21, 2023

(54) POWDER STORAGE DEVICE AND IMAGE-FORMING APPARATUS EQUIPPED WITH THE SAME

(71) Applicant: SHARP KABUSHIKI KAISHA, Sakai (JP)

(72) Inventor: Syohji Tomita, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/939,449

(22) Filed: Sep. 7, 2022

(30) Foreign Application Priority Data

Oct. 14, 2021 (JP) ..... JP2021-168631

(51) Int. Cl.
*G03G 15/08* (2006.01)

(52) U.S. Cl.
CPC ..... *G03G 15/0881* (2013.01); *G03G 15/087* (2013.01); *G03G 15/0822* (2013.01); *G03G 15/0865* (2013.01); *G03G 15/0867* (2013.01); *G03G 15/0882* (2013.01); *G03G 2215/0675* (2013.01); *G03G 2215/0687* (2013.01)

(58) Field of Classification Search
CPC ..... G03G 15/0822; G03G 15/0865; G03G 15/0867; G03G 15/087; G03G 15/0881; G03G 15/0882; G03G 2215/0675; G03G 2215/0687
See application file for complete search history.

(56) References Cited

U.S. PATENT DOCUMENTS

2004/0062573 A1 4/2004 Matsuda et al.
2014/0086620 A1* 3/2014 Takeuchi ..... G03G 21/18 399/258
2017/0285531 A1* 10/2017 Hashimoto ..... G03G 15/0865
2017/0293256 A1* 10/2017 Shida ..... G03G 15/0882

FOREIGN PATENT DOCUMENTS

JP 2004-126018 A 4/2004

* cited by examiner

*Primary Examiner* — Joseph S Wong
(74) *Attorney, Agent, or Firm* — ScienBiziP, P.C.

(57) ABSTRACT

A powder storage device includes a container housing and a powder storage. The container housing is configured to allow the powder container to rotate around a rotation axis α. When the powder container is rotated from an installing position to a predetermined position in a peeling-off rotation direction around the rotation axis α, a supply port moves to a position corresponding to a receiving port, a bonder in which the sealer adheres to the powder container is peeled off, and thus the supply port and the receiving port are interconnected.

10 Claims, 10 Drawing Sheets

POWDER STORAGE DEVICE AND IMAGE-FORMING APPARATUS EQUIPPED WITH THE SAME

BACKGROUND OF THE INVENTION

Field of the Invention

The present disclosure relates to a powder storage device and an image-forming apparatus such as a copier, multi-function peripheral, printer, facsimile machine, etc. equipped with the same.

Description of the Background Art

A powder storage device (e.g., a developing device and/or a toner supply device) equipped in an image-forming apparatus has a container housing that detachably accommodates a powder container (e.g., a developer cartridge and/or a toner cartridge) having a supply port sealed by means of a sealing member, and a powder storage part in which powder (e.g., developer and/or toner) is stored. For example, if the powder storage device is a developing device, powder is developer, the powder container is a developer cartridge, and the powder storage part is a developer tank to contain the developer. When the powder storage device is a toner supply device, the powder is toner, the powder container is a toner cartridge, and the powder storage part is a toner hopper to contain the toner.

In such a powder storage device, when supplying powder from the powder container to the powder storage part, for example, with the container housing being provided above the powder storage part and the supply port which is sealed with the sealing member being faced downward, the powder was fed into the powder storage part causing the powder to fall freely (gravity fall) by a user or a service person peeling off the sealing member along a direction perpendicular to a penetration direction of the supply port. Therefore, there was inconvenience that the peeled-off sealing member is pulled out of the powder storage device, which causes the powder to scatter from the sealing member, and/or soil operator's fingers.

In this regard, conventionally disclosed is a configuration, in which the one end of the sealing tape (sealing member) is fixed, which includes a cartridge cover to peel off the sealing tape while moving from the position covering the supply port to the position opening the supply port in conjunction with the action of installing a cartridge (powder container) into a main body of the image-forming apparatus (container housing), and engaging means for engaging the cartridge cover at the position where the supply port is covered by the cartridge cover.

However, the conventional configuration needs to provide the cartridge cover, which makes the configuration complicated.

An object of the present disclosure is to provide a powder storage device and an image-forming apparatus having a simple configuration capable of avoiding such an inconvenience that powder is scattered from the sealing member and/or fingers of an operator are soiled.

SUMMARY OF THE INVENTION

In order to solve the above-mentioned problems, a powder storage device according to the present disclosure includes: a container housing that a powder container is installed into, the powder container containing powder inside and having a supply port sealed by a sealer; and a powder storage that the powder is supplied to through the supply port, wherein the sealer has a closing seal that seals the supply port in the powder container and a male engager provided at one end of the closing seal in a direction along outer circumference thereof, and the container housing rotatably supports the powder container around a rotation axis and detachably supports the powder container from an installing position where the powder container is installed to an installing direction along the rotation axis direction, the container housing is provided with a female engager to engage with the male engager in the sealer with the powder container being at the installing position, and a receiving port to receive the powder stored in the powder container, and when the powder container rotates around the rotation axis from the installing position in a predetermined peeling-off rotation direction, the supply port moves to a position corresponding to the receiving port and a bonder of the sealer that is adhered to the powder container is peeled off, and thus the supply port and the receiving port are interconnected.

Furthermore, an image-forming apparatus according to the present disclosure includes the powder storage device according to the present disclosure.

According to the present disclosure, it is possible to provide a powder storage device and an image-forming apparatus having a simple configuration capable of avoiding such an inconvenience that powder is scattered from the sealing member and/or fingers of an operator are soiled.

DESCRIPTION OF THE PREFERRED EMBODIMENTS

Now, some embodiments according to the present disclosure are described below with reference to the drawings. In the following, the same parts are denoted by an identical symbol or numeral. The same parts have the same name and function. Therefore, the detailed description thereof is not be repeated.

Image-Forming Apparatus

Figure 1:
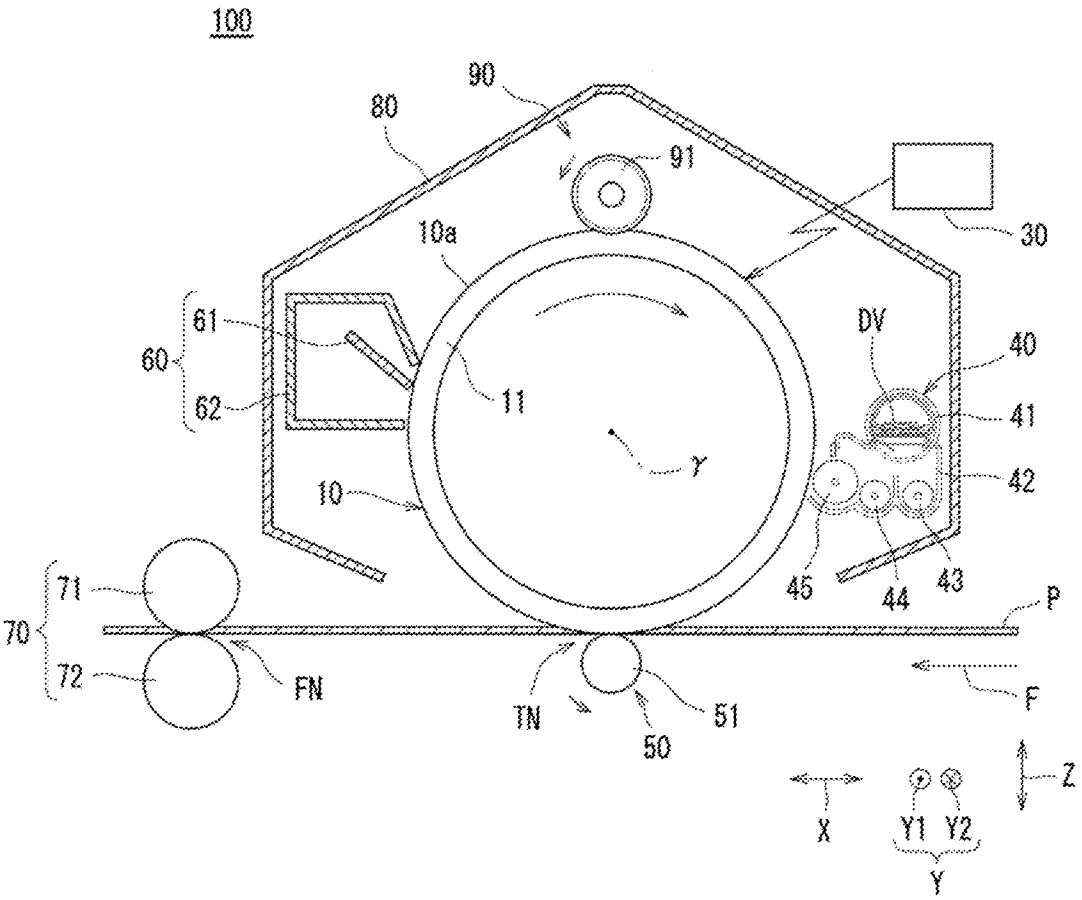
FIG. 1 is a schematic cross-sectional view illustrating a configuration of an image-forming apparatus according to an embodiment of the present disclosure.

FIG. 1 is a schematic cross-sectional view illustrating a configuration of an image-forming apparatus 100 according to an embodiment of the present disclosure. In the drawings, the symbol X indicates a left-right direction. The symbol Y indicates a front-rear direction (depth direction), in which one side Y1 indicates the front side (operation side) and the other side Y2 indicates the rear side (opposite to the operation side). The symbol Z indicates a vertical direction (height direction).

As shown in FIG. 1, an image-forming apparatus 100 includes photoreceptive drum 10 serving as an image carrier, charger 90, exposure device 30, developing device 40, transferer 50, cleaning device 60, and fixing device 70. The charger 90 charges a surface 10*a* of the photoreceptive drum 10. The exposure device 30 exposes the photoreceptive drum 10 charged by the charger 90 to form an electrostatic latent image. The developing device 40 develops the electrostatic latent image formed by the exposure device 30 to form a toner image. The transferer 50 transfers the toner image formed by the developing device 40 onto a recording medium P such as recording paper, etc. The cleaning device 60 removes and collects the toner remaining on the photoreceptive drum 10. The fixing device 70 fixes the toner image transferred by the transferer 50 onto the recording medium P conveyed in a conveyance direction F to form an image. In this example, the image-forming apparatus 100 is a monochrome printer (specifically, a laser printer). The image-forming apparatus 100 may be an intermediate-transfer-typed color image-forming apparatus capable of forming a color image, for example. In addition, although the example illustrates the printer, the image-forming apparatus 100 may be copying machine, multi-function Peripheral, or facsimile machine, for example.

The photoreceptive drum 10 has a base body 11 rotatably supported to a body frame (not shown) of the image-forming apparatus 100, and is rotationally driven around a rotation axis γ.

The charger 90 includes a charging member 91. The charging member 91 uniformly charges the surface 10*a* of the photoreceptive drum 10 to s predetermined potential. The charging member 91 is a charging roller in this example, and is drive to rotate following the rotation of the photoreceptive drum 10. Note that the charging member 91 may be an electrostatic charging charger.

The exposure device 30 repeatedly scans the rotationally-driven surface 10*a* of the photoreceptive drum 10 with light modulated based on image information in a direction of the rotation axis γ of the photoreceptive drum 10, which is the main scanning direction.

The developing device 40 is equipped with developer tank 42 (an example of a powder storage part which is hereinafter referred to as powder storage), stirring-and-transporting roller 43, stirring-and-supplying roller 44, and developing roller 45. The developer tank 42 contains developer DV (an example of powder). Here, as examples of the developer DV, there are a one-component developer consisting mainly of toner and a two-component developer consisting mainly of toner and carrier. When the one-component developer is used as the developer DV, the one-component developer is supplied (filled) to the developer tank 42 from the developer cartridge 200 for the one-component developer, which is accommodated in a container housing 41. Furthermore, when the two-component developer is used as the developer DV, the two-component developer is supplied (filled) to the developer tank 42 from the developer cartridge 200 for the two-component developer, which is accommodated in the container housing 41. In this example, the two-component developer is used as the developer DV.

The stirring-and-transporting roller 43 stirs the developer DV in the developer tank 42 and transports it to the stirring-and-supplying roller 44. The stirring-and-supplying roller 44 supplies the developer DV in the developer tank 42 and transports it to the developing roller 45. The developing roller 45 supplies the developer DV from the stirring-and-supplying roller 44 to the surface 10*a* of the photoreceptive drum 10.

The transferer 50 is equipped with a transfer member 51. The transfer member 51 is a transfer roller in this example, and is driven to rotate following the rotation of the photoreceptive drum 10. Note that the transfer member 51 may be a transfer charger.

The cleaning device 60 includes cleaning blade 61 and collection casing 62. The cleaning blade 61 removes the toner remaining on the surface 10*a* of the photoreceptive drum 10. The collection casing 62 collects the toner removed by the cleaning blade 61. The fixing device 70 includes fusing roller 71 and pressure roller 72 (an example of a pressure component). The pressure roller 72 forms a fusing nip region FN together with the fusing roller 71. Furthermore, the image-forming apparatus 100 includes a housing 80 for accommodating components constituting the image-forming apparatus 100.

Powder Storage Device

First Embodiment

Figure 2A:
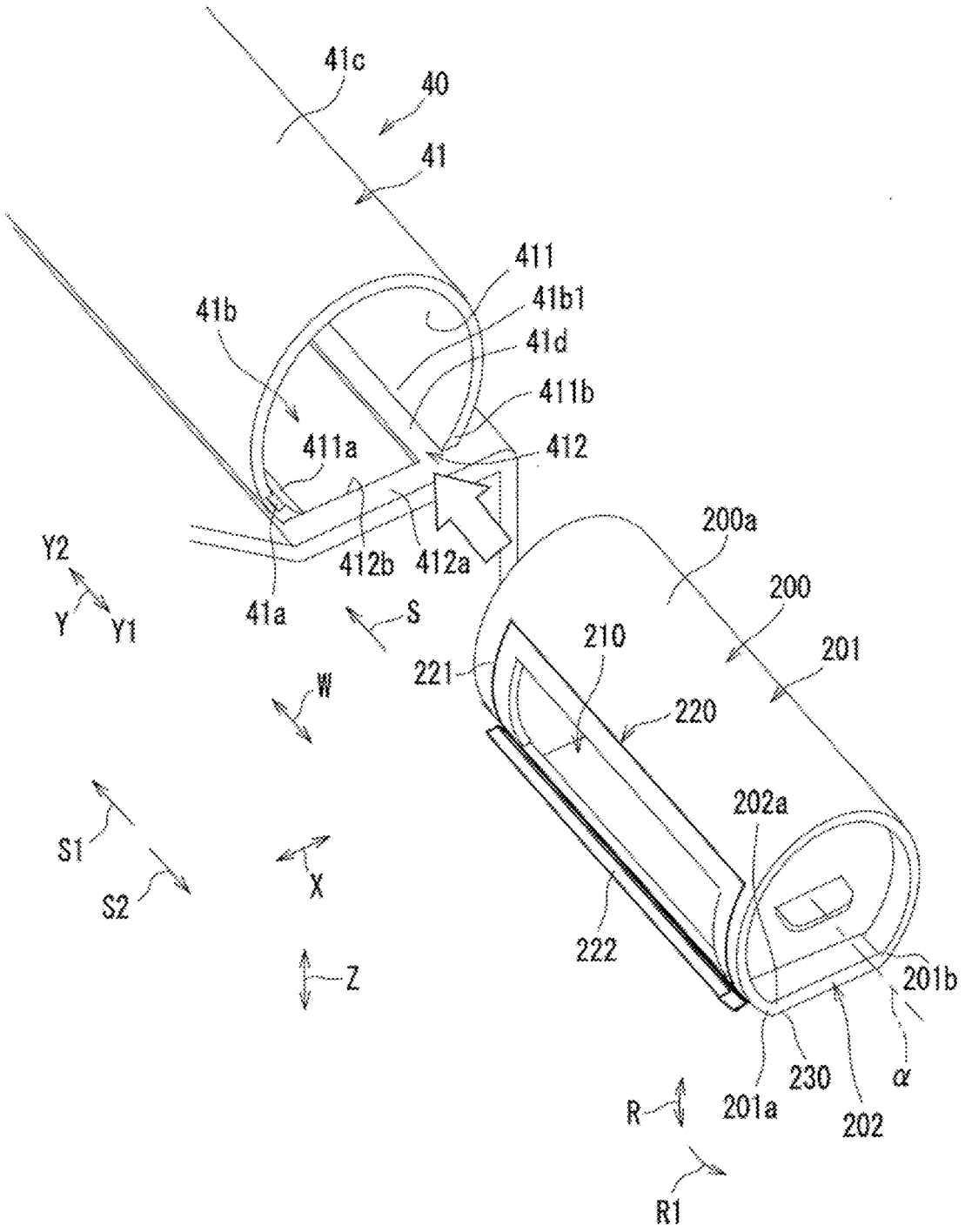
FIG. 2A is a perspective view illustrating a powder container (developer cartridge) before it is installed into a container housing in a powder storage device (developing device) according to the first embodiment.
Figure 2B:
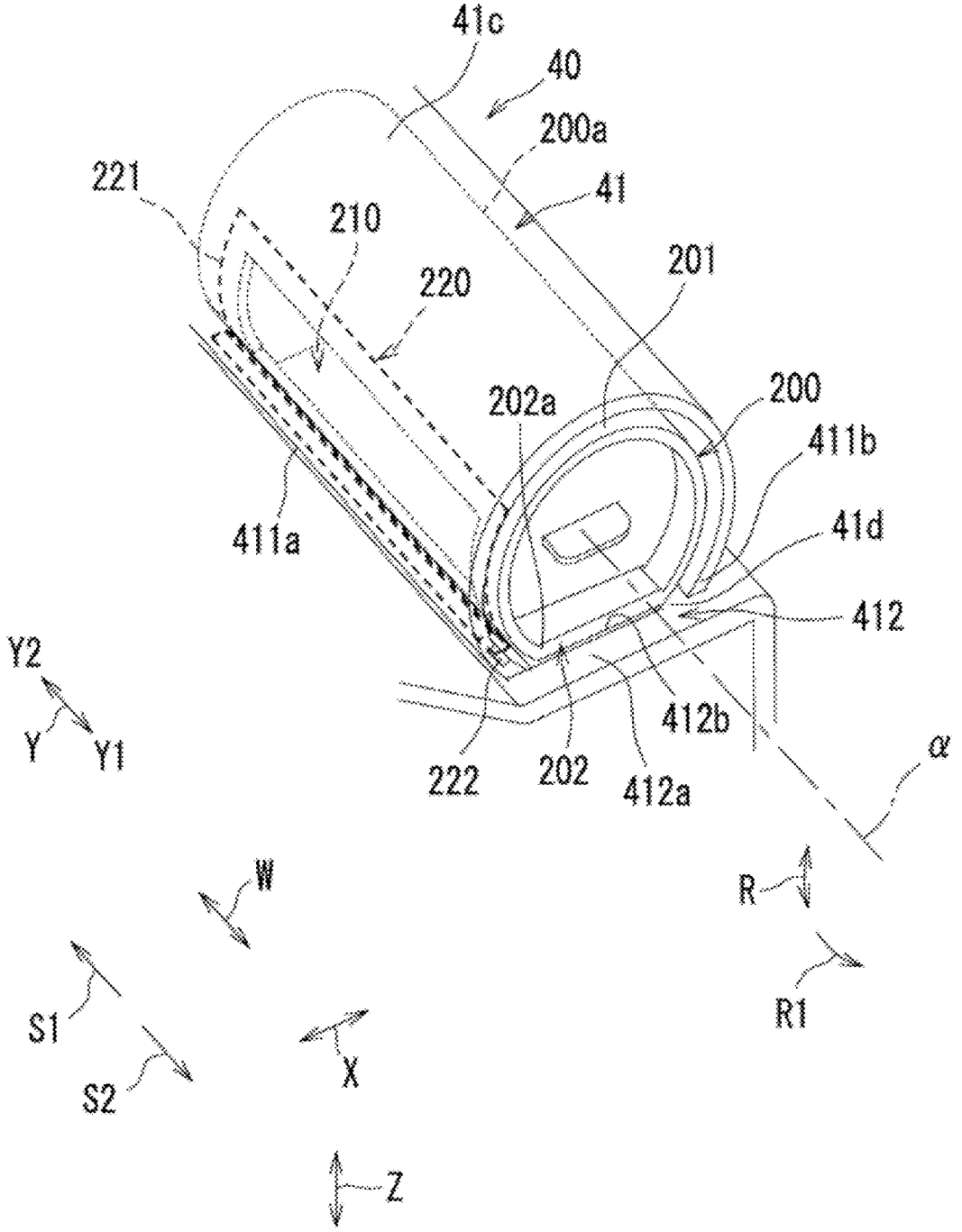
FIG. 2B is a perspective view illustrating the powder container (developer cartridge) after it is installed into the container housing in the powder storage device (developing device) according to the first embodiment.
Figure 3A:
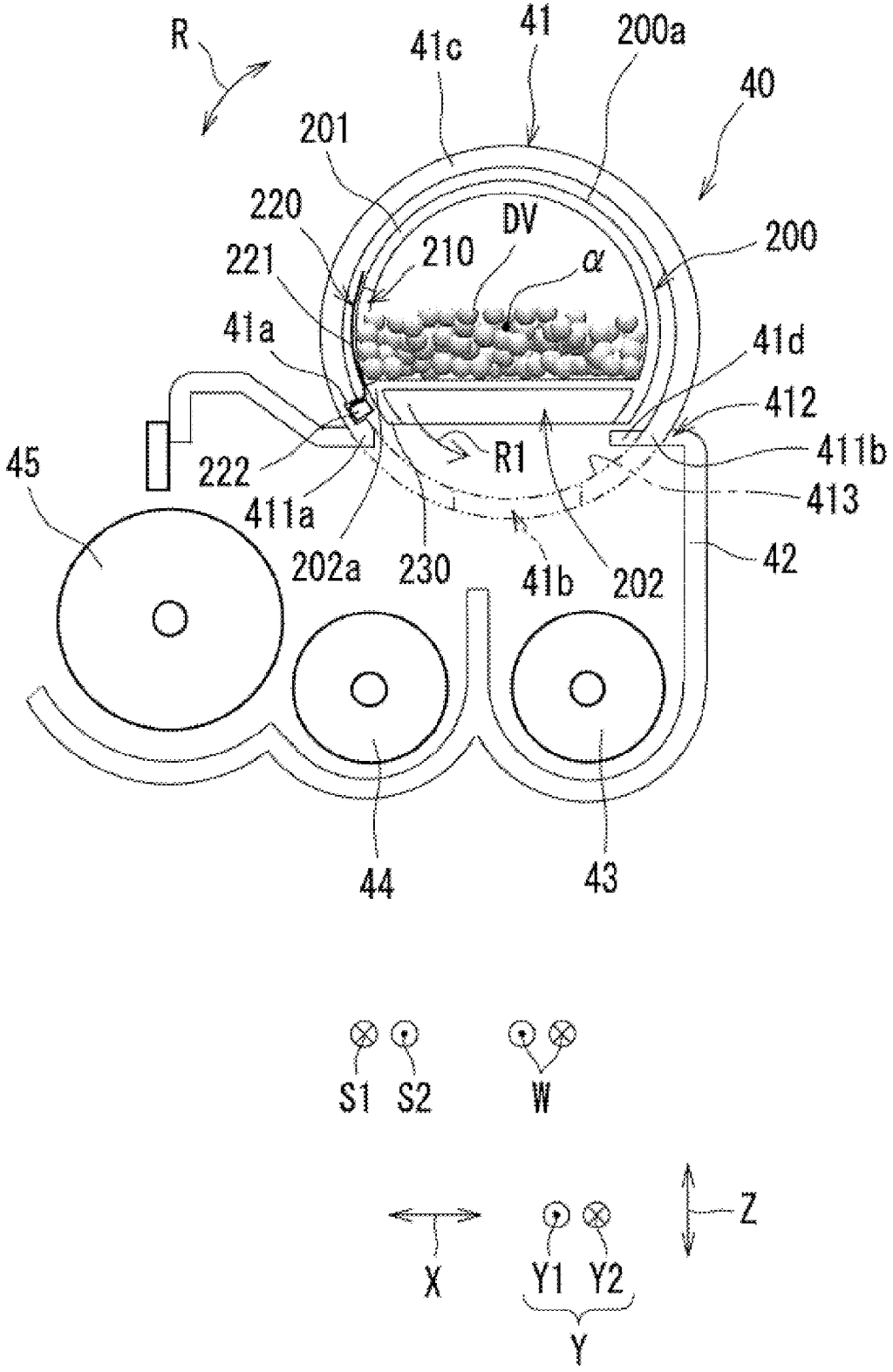
FIG. 3A is a cross-sectional view illustrating the state before powder (developer) is supplied from the powder container (developer cartridge) to a powder storage (developer tank) in the powder storage device (developing device) according to the first embodiment.
Figure 3B:
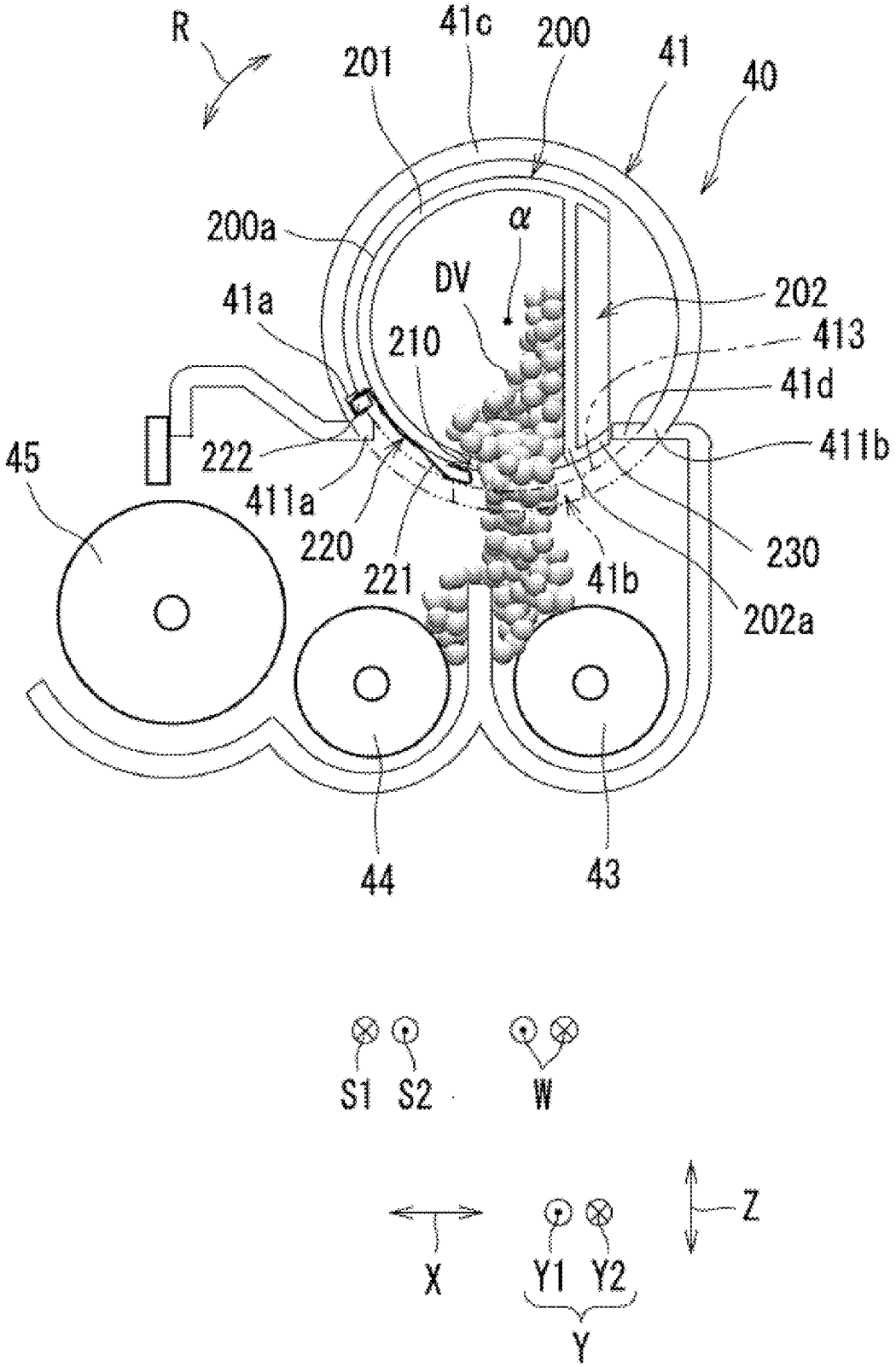
FIG. 3B is a cross-sectional view illustrating the state after the powder (developer) is supplied from the powder container (developer cartridge) to the powder storage (developer tank) in the powder storage device (developing device) according to the first embodiment.
Figure 4A:
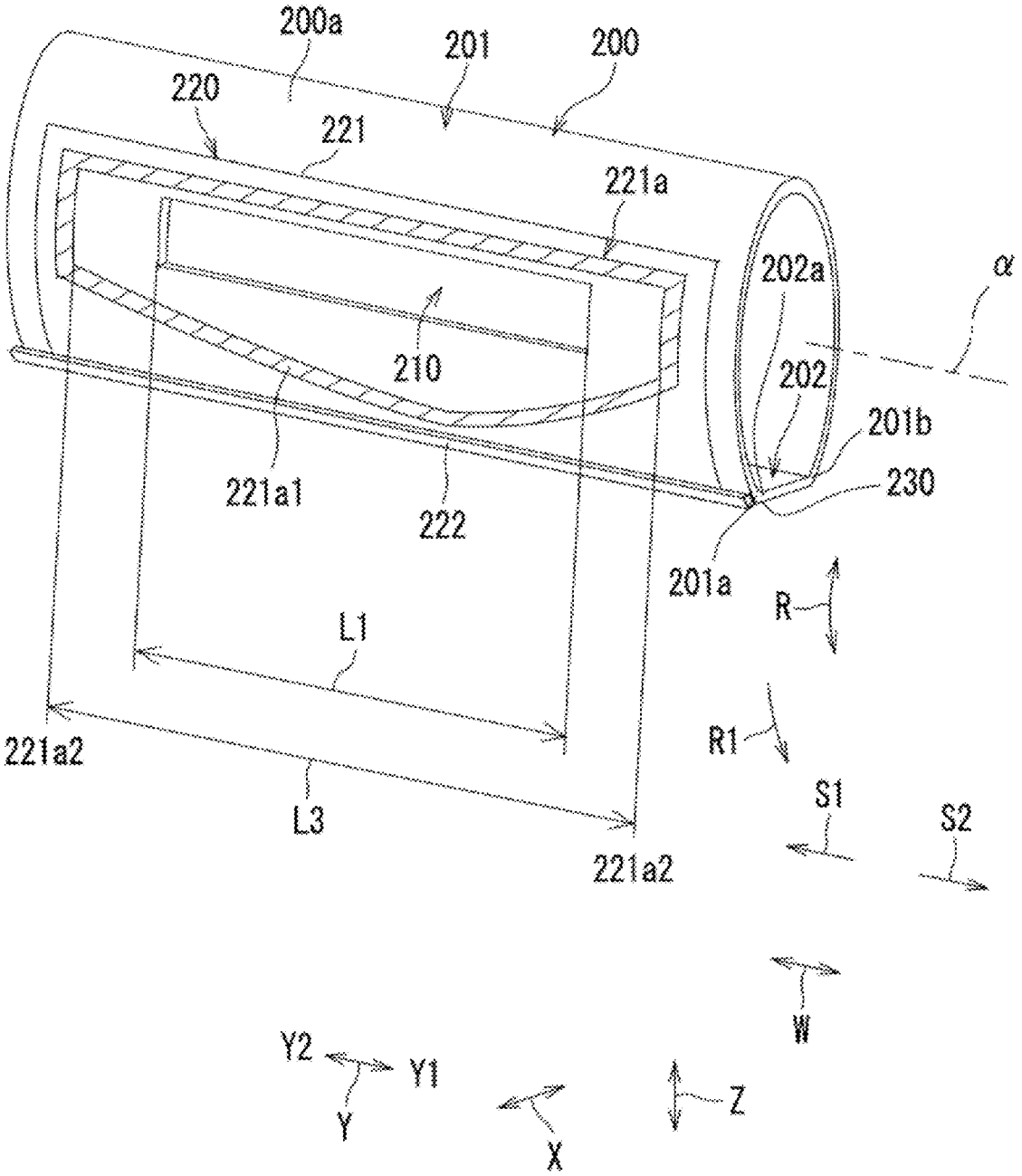
FIG. 4A is a perspective view illustrating the length of a supply port and the length of a bonder in a closing sealer at the powder container (developer cartridge) to be accommodated in the container housing in the powder storage device (developing device) according to the first embodiment.
Figure 4B:
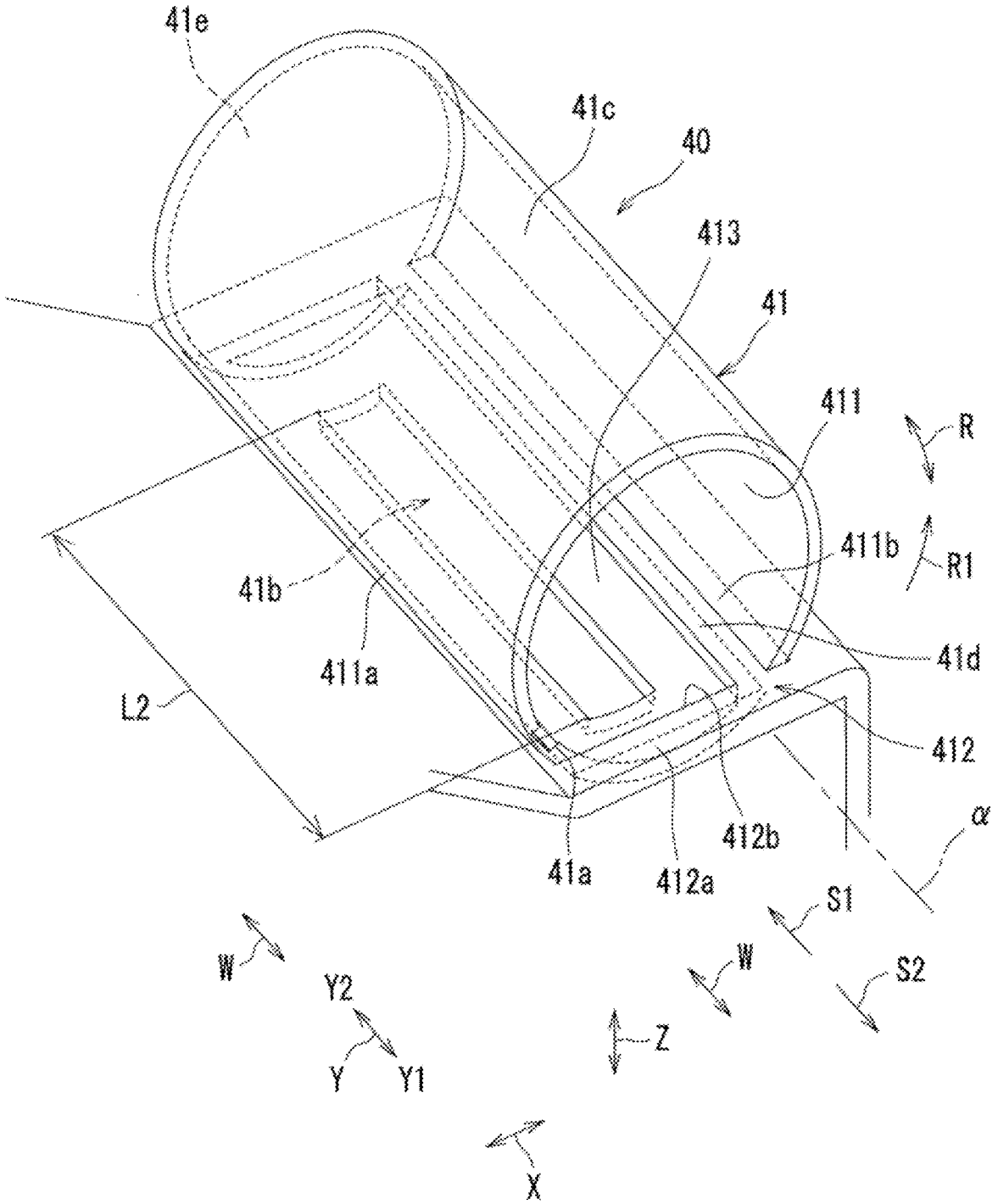
FIG. 4B is a perspective view illustrating the length of a receiving port in the container housing in the powder storage device (developing device) according to the first embodiment.

FIGS. 2A and 2B are perspective views illustrating the states before and after the powder container (corresponding to the developer cartridge 200 and hereinafter occasionally denoted as powder container (200)) is installed into the container housing 41 at the powder storage device (corresponding to the developing device 40 and hereinafter occasionally denoted as powder storage device (40)) according to the first embodiment, respectively. FIGS. 3A and 3B are cross-sectional views illustrating the states before and after the powder (corresponding to the developer DV and hereinafter occasionally denoted as powder (DV)) is supplied from the powder container (developer cartridge 200) to the powder storage (corresponding to the developer tank 42 and hereinafter occasionally denoted as powder storage (42)) at the powder storage device (developing device 40) according to the first embodiment, respectively. FIG. 4A is a perspective view illustrating the length L1 of a supply port 210 and the length L3 of an adhesive part (hereinafter, referred to as bonder) 221*a* in a closing seal 221 at the powder container (developer cartridge 200) to be accommodated in the container housing 41 at the powder storage device (developing device 40) according to the first embodiment. FIG. 4B is a perspective view illustrating the length L2 of a receiving port 41*b* in the container housing 41 at the powder storage device (developing device 40) according to the first embodiment.

The powder storage device (40) has the container housing 41 and the powder container (200). The powder container (200) is installed into the container housing 41. The powder container (200) contains powder (DV) inside and has the supply port 210 which is sealed by a seal member (hereinafter, referred to as sealer) 220. The powder (DV) is supplied to the powder container (200) via the supply port 210.

In detail, the powder storage device (developing device 40) has the container housing 41 into which the powder container (200) is installed and housed, and the powder storage (developer tank 42) in which the powder (developer DV) contained in the powder container is supplied and stored. The container housing 41 detachably accommodates the powder container (200).

The container housing 41 is configured to support the powder container (200) rotatably around a rotation axis α and to support the powder container (200) detachably in an installing direction S1 along a rotation axis direction W from an installing position where the powder container (200) is fixed.

The container housing 41 has an engaged part (hereinafter, referred to as female engager) 41*a* to engage with an engaging part (hereinafter, referred to as male engager) 222 at the sealer 220 in the state where the powder container (200) is in the installing position, and a receiving port 41*b* to receive powder (DV) which is stored in the powder container (200).

Here, the powder container (200) is attached to and detached from the container housing 41 in the installing direction S1 along the rotation axis direction W (front-rear direction in this example). In other words, the container housing 41 supports the powder container (200) detachably along the installing direction S1. Furthermore, the container housing 41 supports the powder container (200) which is being installed into the container housing 41 rotatably around the rotation axis α.

The powder container (200) has the supply port 210 sealed by the sealer 220. Here, the sealer 220 has the closing seal 221 (heat seal) and the male engager 222 (engager for peeling off). The closing seal 221 is used to seal the supply port 210 in the powder container (200). The male engager 222 has a projection part projecting in a direction away from the surface of the powder container, and the projection part is provided at one end of a direction along an outer circumference R of the closing seal 221.

Here, the closing seal 221 (heat seal) can be thermoplastic resins such as a polyvinyl chloride (Poly Vinyl Chloride (PVC)) resin, acrylic (Poly Methyl Methacrylate (PMMA)) resin, polycarbonate (Polycarbonate) resin, Acrylonitrile Butadiene Styrene (Acrylonitrile Butadiene Styrene (ABS)) resin, etc., for example. The male engager 222 is made of a resin material. The closing seal 221 is bonded to the male engager 222 by heat welding.

The container housing 41 has the female engager 41*a* and the receiving port 41*b*. The female engager 41*a* engages with the male engager 222 provided at the sealer 220 in the state where the powder container (200) is installed into the container housing 41. Next, supply operation, in which the supply port 210 sealed by the sealer 220 is released and then powder (developer DV) in the powder container (200) is supplied through the receiving port 41*b* to the powder storage (42), is described below.

When the powder container (200) is rotated from the installing position (the state installed into the container housing 41 shown in FIG. 3A) to a predetermined position in a peeling-off rotation direction R1 around the rotation axis α, the supply port 210 moves to the position corresponding to the receiving port 41*b* (the supply port 210 sealed by the closing seal 221 moves to the side of the receiving port 41*b* in the container housing 41), the bonder 221*a* which is the sealer 220 bonded to the powder container (200) is peeled off, and then the supply port 210 and the receiving port 41*b* are interconnected.

In this embodiment, the powder container (200) is installed into the container housing 41 while the male engager 222 of the powder container (200) is engaged with the female engager 41*a* in the container housing 41. Then, in the state where the powder container (200) is installed into and accommodated in the container housing 41, when the container housing 41 is rotated in a peeling-off rotation direction R1 by an operator such as a user or a service person, the closing seal 221 of the supply port 210 is peeled off from the powder container (200) by the male engager 222 engaging with the female engager 41*a* while the supply port 210 moves toward the receiving port 41*b* in the container housing 41. As a result, as shown in FIG. 3B, the supply port 210 in which the closing seal 221 is peeled off is interconnected with the receiving port 41*b*, so that the powder (DV) in the powder container (200) is supplied from the supply port 210 through the receiving port 41*b* to the powder storage (42).

In this way, according to this embodiment, by the operator rotating the powder container (200) installed into the container housing 41 in the peeling-off rotation direction R1 around the rotation axis α. R1, the closing seal 221 of the supply port 210 is peeled off by means of the male engager 222 engaged with the female engager 41*a* while the supply port 210 moves to the side of the receiving port 41*b* in the container housing 41. Therefore, this makes it possible to simplify the configuration without providing a cartridge cover in the conventional art. Furthermore, since the sealer 220 can be left inside the container housing 41, it is possible to avoid such an inconvenience that powder (DV) is scattered from the sealer 220 and/or fingers of an operator are soiled.

In the present embodiment, the powder container (200) is formed in a cylindrical shape. In this way, the cylindrical shape of the powder container (200) makes it easier to rotate the powder container (200) around the rotation axis α and this allows the closing seal 221 to be surely removed from the powder container (200).

The cylindrical shape can be a cylinder-like shape or a D-shaped cylindrical shape, for example, but in this example the cylindrical shape is a D-shaped cylindrical shape.

Meanwhile, if the rotation range (angle range to be rotated) of the powder container (200) is not restricted, the supply port 210 may not be interconnected with the receiving port 41*b*, so that the supply port 210 of the powder container (200) may be blocked with an outer circumference 41*c* of the container housing 41 other than the receiving port 41*b*. Furthermore, the closing seal 221 may be separated from the powder container (200), so that an opposite side of the closing seal 221 with respect to the male engager 222 may hang down in the powder storage (42).

In the present embodiment, the powder container (200) is provided with a restriction part (hereinafter, referred to as restrictor) 230. The restrictor 230 restricts the rotation of the powder container (200) to a downstream side from a predetermined restriction position (see FIG. 3B) in the peeling-off rotation direction R1 around the rotation axis α. The container housing 41 is provided with a restricted part (hereinafter, referred to as restricted portion) 41*d*. The restricted portion 41*d* is restricted by the restrictor 230 in the powder container (200). Here, the predetermined restriction position is a position where the supply port 210 is interconnected (overlapped) with the receiving port 41*b*, and in this example is also a position where the closing seal 221 is not separated from the powder container (200).

In this way, the powder container (200) is provided with the restrictor 230 to restrict the rotation to the downstream side from the predetermined restriction position, and the container housing 41 is provided with the restricted portion 41*d*, so that it is possible to effectively prevent the receiving port 41*b* from being not interconnected with the supply port 210 and from being blocked with the outer circumference 200*a* other than the supply port 210 of the powder container (200). In addition, it is possible to effectively prevent the opposite side of the closing seal 221 with respect to the male engager 222 from hanging down in the powder storage (42).

In the present embodiment, the powder container (200) is in a D-shaped cylindrical shape, and as shown in FIGS. 2A and 4A, which includes an arcuate portion (hereinafter, referred to as arc) 201 and a plate portion (hereinafter, referred to as plate) 202 which is sandwiched between ends 201*a* and 201*b* of both sides of the arc 201 in the direction along a circumference of the arc 201*a*. The arc 201 is provided with the supply port 210. As shown in FIGS. 2A and 4B, an inner circumferential surface of the container housing 41 has a first arc surface 411 and a planer guide surface 412 connected to ends 411*a* and 411*b* which are both side ends of the first arc surface 411 in the circumferential direction. The guide surface 412 has a second arc surface 413 (concave portion) which allows rotation of the powder container (200) around the rotation axis α (see FIGS. 2A, 3A, 3B, 4B). The receiving port 41*b* (see FIG. 4B) is provided on the second arc surface 413.

In this way, the inner circumference of the container housing 41 has the first arc surface 411 and the planer guide surface 412 connected to ends 411*a* and 411*b* which are both side ends of the first arc surface 411 in the circumferential direction, so that first the plate 202 of the powder container (200) can be placed on an introduction surface 412*a* on an entry side of the guide surface 412*a* of the container housing 41 (see FIGS. 2A, 2B, 4B) and then the plate 202 of the powder container (200) can be guided along the guide surface 412 of the container housing 41 toward the installing direction S1 along the guide surface 412 of the container housing 41. This allows the powder container (200) to be smoothly installed into the container housing 41.

In this example, the end 411*a* of the first arc surface 411 on the downstream side in the peeling-off rotation direction R1 and an end 41*b*1 of the receiving port 41*b* of the first arc surface 411 on the upstream side in the peeling-off rotation direction R1 are connected. Thereby, it is possible to omit to provide the guide surface 412 of the receiving port 41*b* on the upstream side in the peeling-off rotation direction R1. Therefore, even if the closing seal 221 sealing the supply port 210 begins to peel off at the upstream side from the receiving port 41*b* in the peeling-off rotation direction R1, this makes it easy to supply powder (DV) in the powder container (200) from the supply port 210 to the receiving port 41*b*.

In the present embodiment, a portion of the plate 202 in the powder container (200) constitutes the restrictor 230. In the guide surface 412 of the container housing 41, an end on the downstream side from the receiving port 41*b* in the peeling-off rotation direction R1 constitutes the restricted portion 41*d*.

In this way, a portion of the plate 202 in the powder container (200) constitutes the restrictor 230, and the end of the guide surface 412 in the container housing 41 on the downstream side from the receiving port 41*b* in the peeling-off rotation direction R1 constitutes the restricted portion 41*d*, so that further restrictor 230 and restricted portion 41*d* can be omitted, and the powder container (200) can be restricted to rotate to the downstream side from the restriction position despite a simple configuration.

In the present embodiment, a wall 412*b* of the receiving port 41*b*, which is opposite to the installing direction S1 in the container housing 41 (see FIGS. 2A, 2B, 4B), constitutes a stopper portion to prevent the powder container (200) from coming off to a releasing direction S2 opposite to the installing direction S1 of the same.

In this way, the wall 412*b* on the upstream side of the guide surface 412 in the installing direction S1, which faces a second arc surface 413 in the container housing 41, constitutes a stopper portion to prevent the powder container (200) from coming off to a releasing direction S2, so that further stopper portion can be omitted, and the powder container (200) can be prevented from coming off to the releasing direction S2 despite a simple configuration.

In detail, the powder container (200) has the plate 202 in which a portion of the outer circumference 200*a* is formed in a plate shape. The supply port 210 is provided on more upstream side than one side 202*a* on the upstream side from the receiving port 41*b* in the peeling-off rotation direction R1 in the plate 202 of the powder container (200).

Thereby, the supply port 210 from which the closing seal 221 is peeled off can be quickly moved to the receiving port 41*b*, so that leakage of powder (DV) from the receiving port 41*b* can be suppressed.

Radius of curvature of the second arc surface 413 is equal to or substantially equal to that of the first arc surface 411. The restricted portion 41*d* protrudes inwardly in the left-right direction X from the end 411*b* of the first arc surface 411 on the upstream side in the peeling-off rotation direction R1. The introduction surface 412*a* extends from the outer circumference 41*c* in the container housing 41 in the releasing direction S2. The second arc surface 413 in the container housing 41 extends to a wall 41*e* opposite to the entry side in the container housing 41.

In the present embodiment, the female engager 41*a* is provided in the vicinity of or adjacent to (in this example, in the vicinity of) the upstream side of the receiving port 41*b* of the container housing 41 in the peeling-off rotation direction R1.

Thereby, the supply port 210 from which the closing seal 221 is peeled off can be more quickly moved to the receiving port 41*b*, so that leakage of powder (DV) from the receiving port 41*b* can be suppressed.

In the present embodiment, the male engager 222 in the sealer 220 extends in the rotation axis direction W. The female engager 41*a* in the container housing 41 is a guide groove extending in the rotation axis direction W.

Thus, the male engager 222 in the sealer 220 extends in the rotation axis direction W, and the female engager 41*a* in the container housing 41 is a guide groove extending in the rotation axis direction W, so that the closing seal can be peeled off with uniform force in the rotation axis direction.

The male engager 222 is formed in a rod-like shape (in this example, rectangular). In detail, the female engager 41*a* is a guide groove whose both sides are perpendicular to or substantially perpendicular to the bottom corresponding to the shape of the male engager 222.

The closing seal 221 is bonded to the powder container (200) with the annular bonder 221*a* in the outer circumference 200*a* of the powder container (200). In the present embodiment, the bonder 221*a* of the closing seal 221 is bonded by heat welding.

Meanwhile, in the case where an end region of the closing seal 221 on the downstream side in the peeling-off rotation direction R1 of the bonder 221*a* adhering to the outer circumference 200*a* of the powder container (200) is along the rotation axis direction W, the area thereof when the closing seal 221 begins to be peeled off becomes larger, and thus force to peel off the closing seal 221 becomes greater. Here, the bonder 221*a* is formed to surround the supply port 210 with a predetermined width. The width of the bonder 221*a* is, for example, about 2 mm to 3 mm, but not limited thereto.

In this regard, as shown in FIG. 4A, in the present embodiment, the end region 221*a*1 of the closing seal 221 on the downstream side in the peeling-off rotation direction R1 of the bonder 221*a* adhering to the outer circumference 200*a* of the powder container (200) is formed so as to extend in a direction intersecting the rotation axis direction W along which the male engager 222 extends.

Thus, the end region 221*a*1 of the bonder 221*a* is formed in a direction intersecting the rotation axis direction W along which the male engager 222 extends, so that since the closing seal 221 is peeled off diagonally at the end region 221*a*1, the area of the closing seal 221 when it begins to be peeled off can be reduced, and thus force to peel off the closing seal 221 can be lowered.

In the present embodiment, the edge region 221*a*1 of the bonder 221*a* is formed in a V shape whose apex is located on the downstream side in the peeling-off rotation direction R1.

In this way, the edge region 221*a*1 of the bonder 221*a* is formed in a V shape whose apex is located on the downstream side in the peeling-off rotation direction R1, so that force to peel off the closing seal 221 can be uniformly applied to the powder container (200) from the center portion thereof in the peeling-off rotation direction R1, and thus the closing seal 221 can be surely peeled off.

Meanwhile, when the length of the supply port 210 in the powder container (200) in the rotation axis direction W is defined as L1 (see FIG. 4A), and the length of the receiving port 41*b* in the container housing 41 in the rotation axis direction W is defined as L2 (see FIG. 4B), if L1≥L2, there may be the case where the powder (DV) spills over from the supply port 210 to the periphery of the receiving port 41*b*. Furthermore, when the length between both inner edges 221*a*2 and 221*a*2 of the closing seal 221 on the supply port 210 side in the rotation axis direction W of the bonder 221*a* adhering to the outer circumference 200*a* of the powder container (200) is defined as L3 (see FIG. 4A), if L1≥L3, the closing seal 221 cannot reliably seal the entire supply port 210. Furthermore, if L2≥L3, seal fragments (welding fragments), which may be produced when the closing seal 221 is peeled off, may fall down from the receiving port 41*b* into the powder storage (42).

In light of the forgoing, the present embodiment satisfies the condition of L1<L2<L3. Thus, the condition L1<L2 is satisfied, so that the supply port 210 can be located inside the receiving port 41*b*, thereby effectively preventing powder (DV) from spilling over to the periphery of the receiving port 41*b* from supply port 210. The condition L1<L3 is satisfied, so that the closing seal 221 can cover the entire supply port 210, thereby the closing seal 221 can surely seal the entire supply port 210. Furthermore, the condition L2<L3 is satisfied, so that when the powder container (200) rotates in the peeling-off rotation direction R1, the bonder 221*a* of the closing seal 221 on more outside in the rotation axis direction W than the supply port 210 of the bonder 221*a* adhering to the outer circumference 200*a* of the powder container (200) does not pass through the supply port 210, thereby suppressing seal fragments (weld fragments), which may be produced when the closing seal 221 is peeled off, from dropping down from the receiving port 41*b* to the powder storage (42).

In the present embodiment, the container housing 41 is located above the powder storage (42).

In this way, powder (DV) can fall freely from the container housing 41 which is above the powder storage (42) to the powder storage (42) which is below the container housing 41, thereby surely supplying the powder (DV) from the powder container (200) to the powder storage (42).

Second Embodiment

Figure 5A:
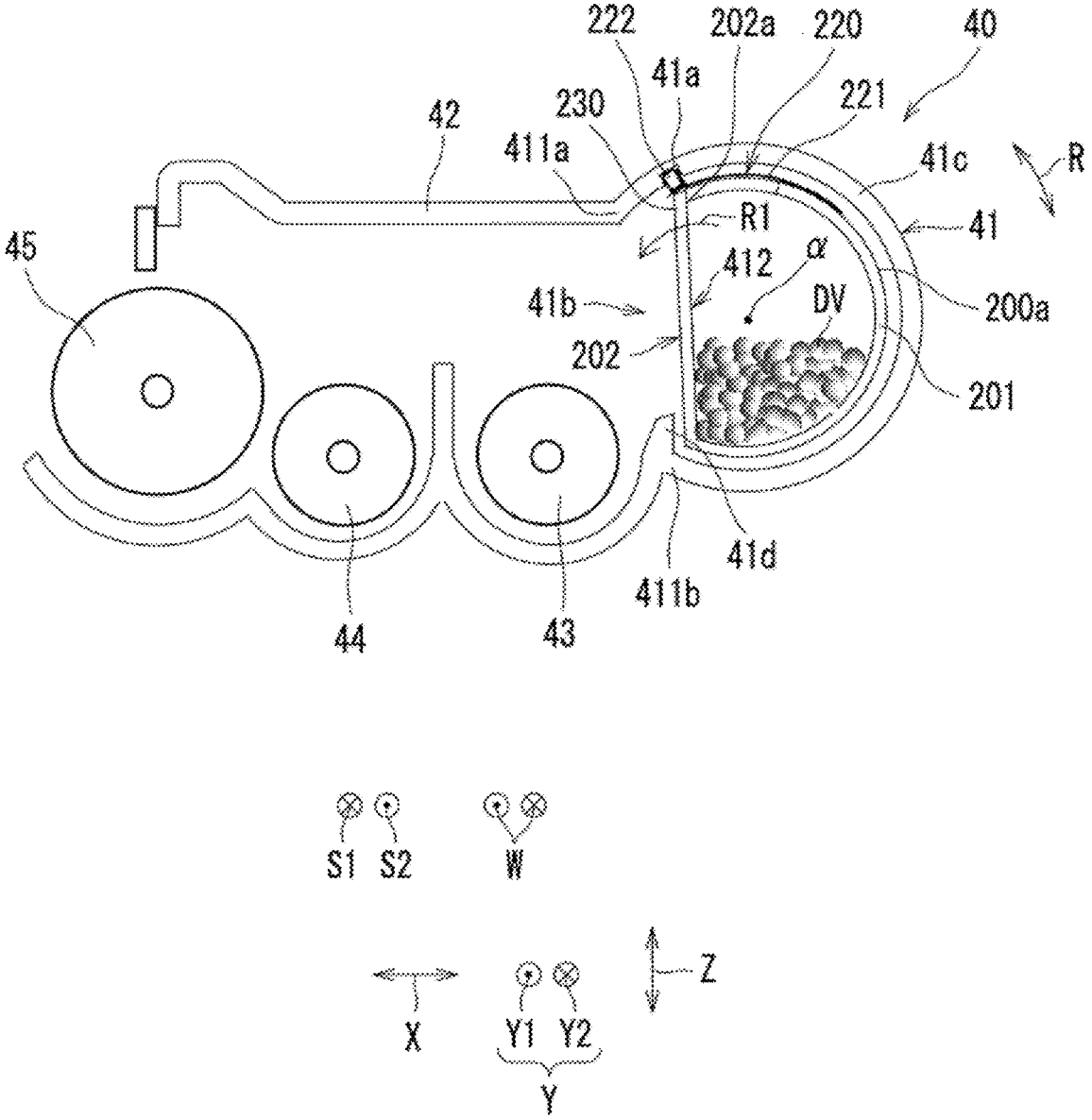
FIG. 5A is a cross-sectional view illustrating the state before the powder (developer) is supplied from the powder container (developer cartridge) to the powder storage (developer tank) in the powder storage device (developing device) according to the second embodiment.
Figure 5B:
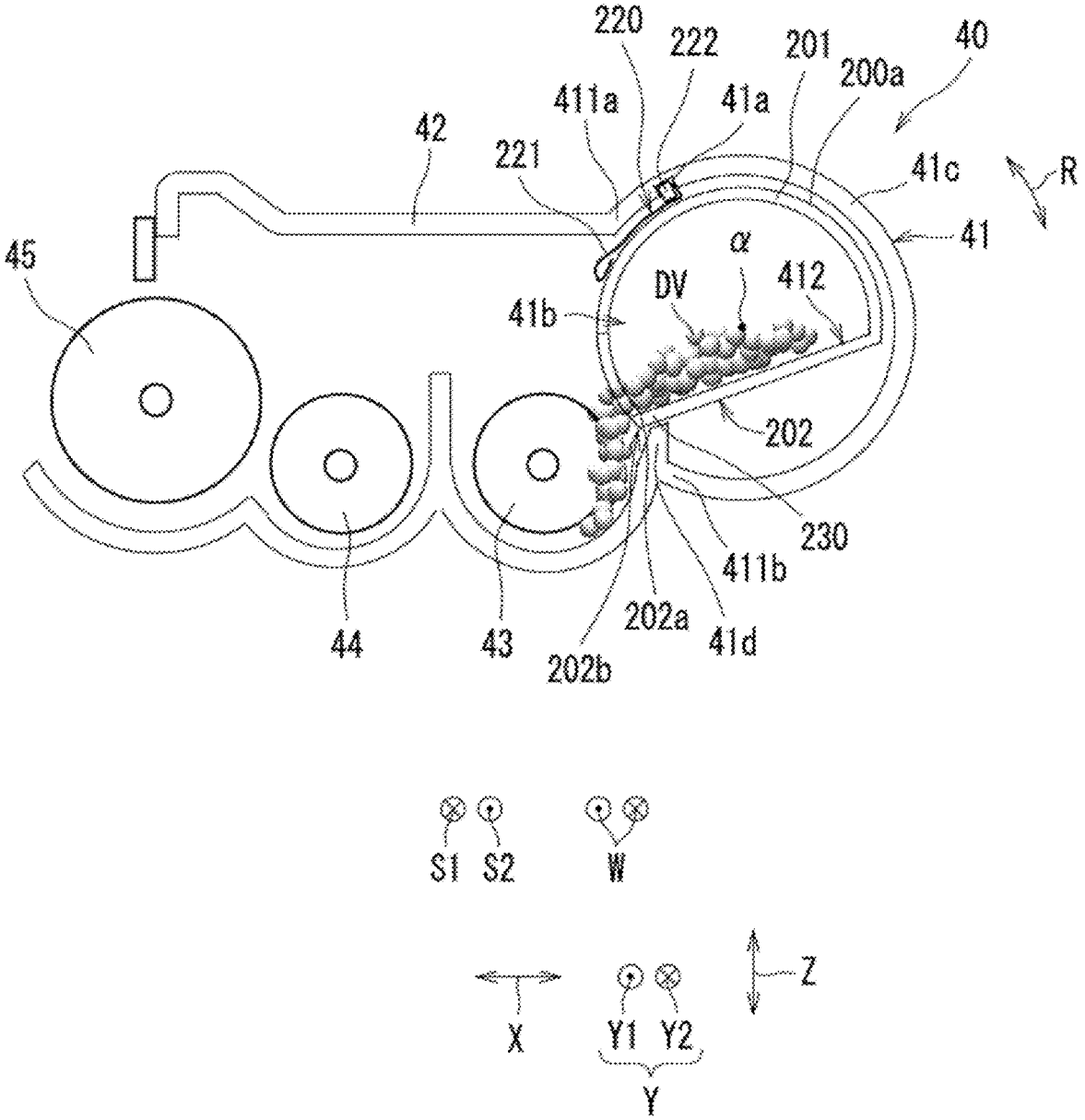
FIG. 5B is a cross-sectional view illustrating the state after the powder (developer) is supplied from the powder container (developer cartridge) to the powder storage (developer tank) in the powder storage device (developing device) according to the first embodiment.

FIGS. 5A and 5B are cross-sectional views illustrating the states before and after the powder (developer DV) is supplied from the powder container (developer cartridge 200) to the powder storage (developer tank 42) at the powder storage device (developing device 40) according to the second embodiment, respectively.

In the powder storage device (developing device 40) according to the second embodiment, substantially the same configurations as those of the powder storage device (developing device 40) according to the first embodiment are denoted by an identical symbol or numeral, and explanation thereof are omitted.

In the present embodiment, the container housing 41 is located horizontally adjacent to the powder storage (42) and orthogonal to the rotation axis α. In this example, the rotation axis α of the powder container (200) is located diagonally upward the roller member (in this example, the stirring-and-transporting roller 43) of the powder storage (42).

In such a configuration, there may be the case where powder (DV) from the container housing 41 cannot fall down from a side of the powder storage (42), which is orthogonally oriented to the rotation axis α of the powder storage (42).

In this regard, the restrictor 230 of the present embodiment restricts the rotation to the downstream side around the rotation axis α from the predetermined restriction position in the peeling-off rotation direction R1 of the powder container (200). The plate 202 is a portion of the outer circumference 200*a* which is formed in a flat plate shape. The container housing 41 is provided with a restricted part (hereinafter, referred to as restricted portion) 41*d*. The restricted portion 41*d* is restricted by the restrictor 230 in the powder container (200). When the powder container (200) is placed in the restriction position, the plate 202 is inclined with respect to a horizontal direction so that an edge 202*b* of the receiving port 41*b* (see FIG. 5B) is directed toward downward.

In this way, when the powder container (200) is placed in the restriction position, the plate 202 is inclined with respect to the horizontal direction so that the edge 202*b* of the receiving port 41*b* is directed toward downward, so that even when the container housing 41 is provided on a horizontal side of the powder storage (42), powder (DV) from the container housing 41 can freely fall down from the side of the powder storage (42) to the powder storage (42), thereby surely supplying powder (DV) from the powder container (200) to the powder storage (42).

In detail, the supply port 210 is connected to one side 202*a* of the plate 202 in the powder container (200), which is on the upstream side from the receiving port 41*b* in the peeling-off rotation direction R1.

In this way, the supply port 210 is connected to one side 202*a* of the plate 202 in the powder container (200), which is on the upstream side from the receiving port 41*b* in the peeling-off rotation direction R1, so that powder (DV) from the container housing 41 can easily fall down freely from the side of the powder storage (42) from the powder storage (42), thereby surely supplying powder (DV) from the powder container (200) to the powder storage (42).

In the present embodiment, powder (DV) is developer, the powder container is a developer cartridge 200, the powder storage is a developer tank 42 in which the powder storage contains developer DV, and the powder storage device is a developing device 40, so that the powder storage device according to the present embodiment can be preferably applied to the developing device 40.

Third Embodiment

Figure 6:
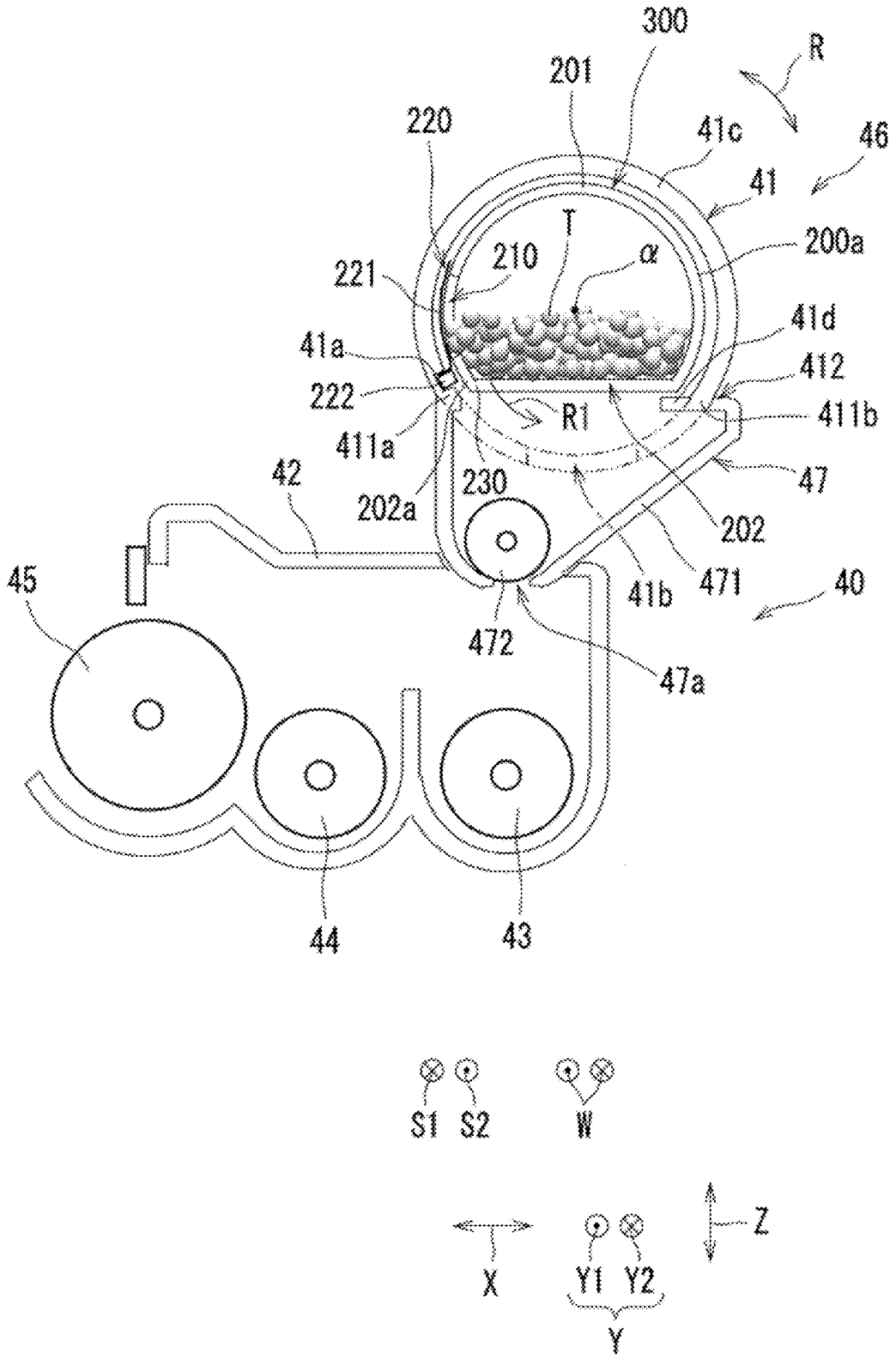
FIG. 6 is a cross-sectional view illustrating the state before the powder (toner) is supplied from the powder container (toner cartridge) to the powder storage (toner hopper) in the powder storage device (toner supply device) according to the third embodiment.

FIG. 6 is a cross-sectional view illustrating the state before the powder (corresponding to the toner T) is supplied from the powder container (corresponding to the toner cartridge 300 and hereinafter occasionally denoted as powder container (300)) to the powder storage (corresponding to the toner hopper 47) in the powder storage device (corresponding to the toner supply device 46) according to the third embodiment.

The example in FIG. 6 shows a toner supply device 46 to which the powder storage device according to a third embodiment is applied, in place of the developing device 40 to which the powder storage device according to the first and second embodiments is applied.

In the powder storage device (toner supply device 46) according to the third embodiment, substantially the same configurations as those of the powder storage device (developing device 40) according to the first embodiment are denoted by an identical symbol or numeral, and explanation thereof are omitted.

In the present embodiment, by an operator rotating the powder container (300) accommodated in the container housing 41 around the rotation axis α in the predetermined peeling-off rotation direction R1, powder (toner T) stored in the powder container (300) is supplied to the powder storage (toner hopper 47). Here, a toner supply port 47*a* is provided at the bottom of a toner hopper body 471 which is a main body of the powder storage (toner hopper 47). Furthermore, a toner supply roller 472 (roller member) to supply toner T to the developer tank 42 is provided above the toner supply port 47*a* of the toner hopper body 471.

In the present embodiment, toner in a two-component developer DV is consumed as the developing operation of the developing device 40 is performed. If the ratio of toner to developer DV becomes smaller than the predetermined reference value, the powder (toner T) retained in the powder storage (toner hopper 47) is supplied to the developer tank 42 through the toner supply port 47*a* by the rotation of the toner supply roller 472.

In the powder storage device (toner supply device 46) according to the third embodiment, by the operator the powder container (toner cartridge 300) installed into the container housing 41 is rotated around the rotation axis α in the predetermined peeling-off rotation direction R1, so that the closing seal 221 of the supply port 210 can be peeled off from the powder container (toner cartridge 300) while the supply port 210 is moved toward the receiving port 41*b* side in the container housing 41, and thus powder (toner T) can be supplied from the receiving port 41*b* to the powder storage (toner hopper 47).

In the present embodiment, powder is toner T, the powder container is a toner cartridge (300), the powder storage is a toner hopper 47 containing the toner T, and the powder storage device is a toner supply device 46, so that the powder storage device according to the present embodiment can be preferably applied to the toner supply device 46.

The present disclosure is not limited to the embodiments described above, but can be carried out in various other forms. Therefore, such embodiments are merely examples in all respects and should not be construed as limiting. The scope of the present disclosure is indicated by the appended claims and is not bound in any way by the text of the specification. Furthermore, all modifications and variations belonging to the equivalent scope of the claims are within the scope of the disclosure.

What is claimed is:

1. A powder storage device comprising:

a container housing into which a powder container is installed, the powder container containing powder inside and having a supply port sealed by a sealer; and a powder storage to which the powder is supplied through the supply port, wherein the sealer has a closing seal that seals the supply port in the powder container and a male engager provided at one end of the closing seal in a direction along outer circumference thereof, and the container housing rotatably supports the powder container around a rotation axis and detachably supports the powder container from an installing position where the powder container is installed to an installing direction along a direction of the rotation axis, the container housing is provided with a female engager to engage with the male engager in the sealer with the powder container being at the installing position, and a receiving port to receive the powder stored in the powder container, and when the powder container rotates around the rotation axis from the installing position to a predetermined position in a peeling-off rotation direction, the supply port moves to a position corresponding to the receiving port and a bonder of the sealer that is adhered to the powder container is peeled off, and thus the supply port and the receiving port are interconnected.

2. The powder storage device according to claim 1, wherein the powder container is formed in a cylindrical shape.

3. The powder storage device according to claim 1, wherein the powder container is provided with a restrictor that restricts rotation of the powder container around the rotation axis to a downstream side from a predetermined restriction position in the peeling-off rotation direction, and the container housing is provided with a restricted portion that is restricted by the restrictor in the powder container.

4. The powder storage device according to claim 1, wherein the powder container includes an arc and a plate that is connected to both ends of the arc in a direction of circumference of the arc, and the arc has the supply port, the container housing includes an inner circumferential surface that has a first arc surface and a planar guide surface connected to both ends of the first arc surface in the direction of circumference of the first arc surface, the guide surface has a second arc surface that allows rotation of the powder container around the rotation axis, and the second arc surface has the receiving port.

5. The powder storage device according to claim 4, wherein the powder container is provided with a restrictor that restricts rotation of the powder container around the rotation axis to a downstream side from a predetermined restriction position in the peeling-off rotation direction, the container housing is provided with a restricted portion that is restricted by the restrictor in the powder container, and a portion of the plate in the powder container forms the restrictor, and an end of the guide surface of the container housing that is on a downstream side from the receiving port in the peeling-off rotation direction forms the restricted portion.

6. The powder storage device according to claim 4, wherein a wall of the receiving port in the container housing that is on an opposite side in the installing direction forms a stopper to prevent the powder container from coming off to a releasing direction opposite to the installing direction of the powder container.

7. The powder storage device according to claim 1, wherein the male engager in the sealer extends in the rotation axis direction, and the female engager in the container housing is a guide groove that extends in the rotation axis direction.

8. The powder storage device according to claim 7, wherein an end region on a downstream side in the peeling-off rotation direction of the bonder of the closing seal that adheres to an outer circumference of the powder container is formed in a direction intersecting the rotation axis direction aligned with a direction that the male engager extends, and the end region of the bonder is formed in a V-shape with an apex thereof being on a downstream side in the peeling-off rotation direction.

9. The powder storage device according to claim 1, wherein if a length of the supply port in the powder container in the rotation axis direction is L1, a length of the receiving port in the container housing in the rotation axis direction is L2, and a length between both inner edges on the supply port side in the rotation axis direction of the bonder of the closing seal that adheres to an outer circumference of the powder container is L3, a condition $L1<L2<L3$ is satisfied.

10. An image-forming apparatus comprising the powder storage device according to claim 1.

* * * * *